US010665156B2

(12) United States Patent
Huang et al.

(10) Patent No.: US 10,665,156 B2
(45) Date of Patent: May 26, 2020

(54) VOLTAGE COMPENSATION DEVICE, METHOD FOR VOLTAGE COMPENSATION AND DISPLAY DEVICE

(71) Applicant: BOE TECHNOLOGY GROUP CO., LTD., Beijing (CN)

(72) Inventors: Chienpang Huang, Beijing (CN); Ling Shi, Beijing (CN); Li Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 27 days.

(21) Appl. No.: 15/983,429

(22) Filed: May 18, 2018

(65) Prior Publication Data

US 2019/0180676 A1 Jun. 13, 2019

(30) Foreign Application Priority Data

Dec. 12, 2017 (CN) ..... 2017 1 1320842

(51) Int. Cl.
*G09G 3/3208* (2016.01)

(52) U.S. Cl.
CPC ..... *G09G 3/3208* (2013.01); *G09G 2320/029* (2013.01); *G09G 2320/0257* (2013.01);
(Continued)

(58) Field of Classification Search
CPC ..... G09G 2320/041; G09G 3/3208
See application file for complete search history.

(56) References Cited

U.S. PATENT DOCUMENTS

2006/0012590 A1 1/2006 Takeoka
2007/0075940 A1* 4/2007 Nakamura ..... G09G 3/325 345/77

(Continued)

FOREIGN PATENT DOCUMENTS

CN 1897093 A 1/2007
CN 1952736 A 4/2007

(Continued)

OTHER PUBLICATIONS

First Office Action for CN Application No. 201711320842.5 dated May 17, 2019.

(Continued)

*Primary Examiner* — Hang Lin
(74) *Attorney, Agent, or Firm* — Foley & Lardner LLP

(57) ABSTRACT

The present disclosure provides a voltage compensation device, a method for voltage compensation and a display device. The voltage compensation device comprises a plurality of thermosensitive sensors, a processor and a power source management module. Each thermosensitive sensor corresponds to one or more pixel units of a display device and is disposed at a position corresponding to the one or more pixel units. For each thermosensitive sensor and one or more pixel units that corresponds to the thermosensitive sensor, the processor is configured to: determine an actual pixel voltage of the one or more pixel units; determine a compensated data signal; transmit the compensated data signal to the power source management module; and control the power source management module to output a compensated data voltage to the one or more pixel units, enabling the one or more pixel units to reach or approach the reference pixel voltage.

18 Claims, 4 Drawing Sheets

(52) U.S. Cl.
CPC . *G09G 2320/041* (2013.01); *G09G 2330/021* (2013.01); *G09G 2330/028* (2013.01)

(56) References Cited

U.S. PATENT DOCUMENTS

| | | | | |
|---|---|---|---|---|
| 2008/0018569 | A1* | 1/2008 | Sung ..... | G09G 3/3233 345/82 |
| 2010/0066767 | A1 | 3/2010 | Leo et al. | |

FOREIGN PATENT DOCUMENTS

| | | | |
|---|---|---|---|
| CN | 102486912 | A | 6/2012 |
| CN | 105931596 | A | 9/2016 |
| CN | 107068061 | A | 8/2017 |
| JP | 11-064826 | A | 3/1999 |

OTHER PUBLICATIONS

Second Office Action for CN Application No. 201711320842.5 dated Oct. 31, 2019.

* cited by examiner

VOLTAGE COMPENSATION DEVICE, METHOD FOR VOLTAGE COMPENSATION AND DISPLAY DEVICE

CROSS-REFERENCE TO RELATED APPLICATIONS

This application claims priority to and the benefit of Chinese Patent Application No. 201711320842.5, filed on Dec. 12, 2017, which is incorporated herein by reference in its entirety.

TECHNICAL FIELD

The present disclosure relates to a voltage compensation device, a method for voltage compensation and a display device.

BACKGROUND

At present, a AMOLED (Active Matrix Organic Light-emitting Diode) panel is advantageous for its high contrast, ultra-thinness and lightness and bendability, so it receives more and more attention of users.

There is a need for an improved compensation technology for the AMOLED panel.

SUMMARY

The present disclosure provides a voltage compensation device, a method for voltage compensation and a display device.

At least one embodiment of the present disclosure provides a voltage compensation device, comprising: a plurality of thermosensitive sensors, each of which corresponds to one or more pixel units of a display device and is disposed at a position corresponding to the one or more pixel units; a power source management module; and a processor electrically connected to the plurality of thermosensitive sensors and the power source management module. For each thermosensitive sensor of the plurality of thermosensitive sensors and the one or more pixel units that corresponds to the thermosensitive sensor, the processor being configured to: determine, according to an electrical signal indicative of temperature received from the thermosensitive sensor, an actual pixel voltage of the one or more pixel units; determine, according to a difference between the actual pixel voltage and a reference pixel voltage of the one or more pixel unit that has been determined in advance, a compensated data signal; transmit the compensated data signal to the power source management module; and control the power source management module to output a compensated data voltage to the one or more pixel units according to the compensated data signal, enabling the one or more pixel units to reach or approach the reference pixel voltage.

In an example, each pixel unit of the one or more pixel units comprises an organic light-emitting diode (OLED), and one thermosensitive sensor of the plurality of thermosensitive sensors is provided for the OLED of each pixel unit.

In an example, the one thermosensitive sensor is provided in a cathode layer of the OLED.

In an example, the display device comprises a plurality of display areas each with more than one pixel unit, each pixel unit comprises an organic light-emitting diode (OLED), and one thermosensitive sensor of the plurality of thermosensitive sensors is provided for OLEDs of the more than one pixel unit within each display area.

In an example, the one thermosensitive sensor is provided in a cathode layer of the OLEDs.

In an example, the display device further comprises a thin film encapsulation layer, and the plurality of thermosensitive sensors are provided in the thin film encapsulation layer.

In an example, the display device further comprises a heat sink, and the plurality of thermosensitive sensors are provided on the heat sink.

In an example, the plurality of thermosensitive sensors are electrically connected to the processor via at least one of an Inter-Integrated Circuit (I2C) or a Serial Peripheral Interface (SPI).

At least one embodiment of the present disclosure provides a display device, comprising: a display panel comprising a plurality of pixel units; and a voltage compensation device. The voltage compensation device comprises: a plurality of thermosensitive sensors, each of which corresponds to one or more pixel units of the plurality of pixel units and is disposed at a position corresponding to the one or more pixel units; a power source management module; and a processor, electrically connected to the plurality of thermosensitive sensors and the power source management module. For each thermosensitive sensor of the plurality of thermosensitive sensors and one or more pixel units that corresponds to the thermosensitive sensor, the processor being configured to: determine, according to an electrical signal indicative of temperature received from the thermosensitive sensor, an actual pixel voltage of the one or more pixel units; determine, according to a difference between the actual pixel voltage and a reference pixel voltage of the one or more pixel units that has been determined in advance, a compensated data signal; transmit the compensated data signal to the power source management module; and control the power source management module to output a compensated data voltage to the one or more pixel units according to the compensated data signal, enabling the one or more pixel units to reach or approach the reference pixel voltage.

In an example, each pixel unit of the one or more pixel units comprises an organic light-emitting diode (OLED), and one thermosensitive sensor of the plurality of thermosensitive sensors is provided for the OLED of each pixel unit.

In an example, the one thermosensitive sensor is provided in a cathode layer of the OLED.

In an example, the display device comprises a plurality of display areas each with more than one pixel unit, each pixel unit comprises an organic light-emitting diode (OLED), and one thermosensitive sensor is provided for OLEDs of the more than one pixel unit within each display area.

In an example, the thermosensitive sensor is provided in a cathode layer of the OLEDs.

In an example, the display device further comprises a thin film encapsulation layer, and the plurality of thermosensitive sensors are provided in the thin film encapsulation layer.

In an example, the display device further comprises a heat sink, and the plurality of thermosensitive sensors are provided on the heat sink.

At least one embodiment of the present disclosure provides a method for voltage compensation, comprising: receiving an electrical signal indicative of temperature from each thermosensitive sensor of a plurality of thermosensitive sensors; for one or more pixel units corresponding the thermosensitive sensor, determining, according to the electrical signal indicative of temperature, an actual pixel voltage of the one or more pixel units; determining a compensated data signal according to a difference between the actual pixel voltage and a reference pixel voltage of the one or more pixel units that has been determined in advance; transmitting the compensated data signal to a power source management module; and controlling the power source management module to output a compensated data voltage to the one or more pixel units according to the compensated data signal, such that the one or more pixel units reach the reference pixel voltage.

In an example, determining, according to the electrical signal indicative of temperature, the actual pixel voltage of the one or more pixel units comprises: determining, according to correspondences between temperatures and actual pixel voltages that have been determined in advance, the actual pixel voltage of the one or more pixel units corresponding to the electrical signal indicative of temperature.

In an example, the method further comprises, prior to receiving the electrical signal indicative of temperature from each thermosensitive sensor of the plurality of thermosensitive sensors: determining, according to a brightness signal of the one or more pixel units, a reference pixel voltage corresponding to the one or more pixel units; and controlling the power source management module to output to the one or more pixel units an initial source end voltage that is numerically equal to the reference pixel voltage.

Additional aspects and advantages of the present disclosure will be described below, which will become apparent from the descriptions below, or will be learnt from practicing the present disclosure.

BRIEF DESCRIPTION OF THE DRAWINGS

The above-mentioned and/or additional aspects and advantages of the present disclosure will become apparent and understandable from the following descriptions on the embodiments with reference to the drawings, wherein.

DETAILED DESCRIPTION

Figure 1:
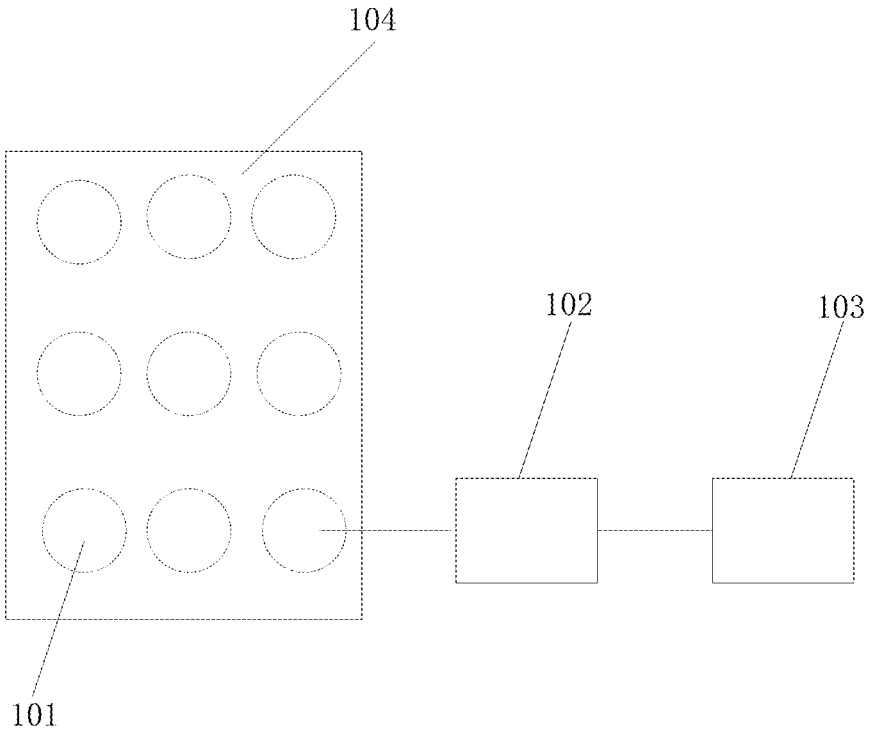
FIG. 1 is a schematic diagram showing the structure of display device including a voltage compensation device according to at least one embodiment of the present disclosure.

Embodiments of the present disclosure will be described in details below. Examples of the embodiments are illustrated in the drawings, in which the same or similar reference signs always represent the same or similar elements or elements having the same or similar functions. The embodiments described below with reference to the drawings are exemplary and used only to interpret the present disclosure, but shall by no means be interpreted as limitations on the present disclosure.

It is understandable to those skilled in the art that unless particularly declared, single forms used here, such as "a", "one", "said" and "this" may include plural forms thereof. It shall be further understood that the wording "comprise" used in the description of the present disclosure means that the feature, integer, step, operation, element and/or component are present, without exclusion of the case that one or more other features, integers, steps, operations, elements, components and/or groups thereof are present or added. It shall be understood that when it is called the element is "connected" or "coupled" to another element, it may be connected or coupled to the other element directly or via an intermediate element. In addition, "connection" or "coupling" as used here may include wireless connection or wired coupling. The wording "and/or" as used here includes all of one or more associated items as listed or any unit and all combinations thereof.

It is understandable to those skilled in the art unless otherwise defined, all terms as used here (including technological terms and scientific terms) have the same meaning as generally understood by ordinary technicians in the field to which the present disclosure pertains. It shall also be understood that those terms as defined in general dictionaries shall be understood as having meanings consistent with context of related technologies, and unless particularly defined here, they shall not be interpreted with ideal or too formal meanings.

Although AMOLED has been developed relatively mature up till now, it still has some shortcomings. For example, evenness in brightness and residual images are two problems facing at present. In particular, under long-term pressurization and high temperature, respective areas in the display panel of a display would have threshold voltages drifts. Depending on the image displayed, the threshold drifts in the respective areas of the display panel differ from one another, which would result in differences in display brightness in the respective areas of the display panel. Since such differences are associated with the image displayed on the display panel, residual images would occur.

In related technologies, in order to solve the above two problems, in addition to improvements on the process, compensation technologies have to be used. Common compensation technologies include internal compensation and external compensation, wherein external compensation refers to a method for compensation by sensing electronic or optical characteristics of pixels using an external driving circuit or device.

In the external compensation, the device for sensing pixels has a high cost, and the process of sensing pixels by the device costs a lot of time. Thus, at present, a compensation method or device that can improve image displaying quality of the display with low cost and less time is desired.

Respective embodiments of the present disclosure will be described in details below.

At least one embodiment of the present disclosure provides a voltage compensation device, the structure of which is as shown in FIG. 1. The voltage compensation device may comprise: a plurality of thermosensitive sensors 101, a processor 102 and a power source management module 103. Both the plurality of thermosensitive sensors 101 and the power source management module 103 are electrically connected to the processor 102. Each thermosensitive sensor of the the plurality of thermosensitive sensors 101 corresponds to one or more pixel unit and is disposed at a position corresponding to the one or more pixel unit (e.g., one or more pixel unit of a display device).

For the one or more pixel unit corresponding to the thermosensitive sensor, the processor 102 is configured to: determine, according to an electrical signal indicative of temperature fed back from each thermosensitive sensor of the plurality of thermosensitive sensors, an actual pixel voltage of the one or more pixel unit corresponding to the thermosensitive sensor of the plurality of thermosensitive sensors 101; determine, according to a difference between the actual pixel voltage and a reference pixel voltage of the one or more pixel unit that has been determined in advance, a compensated data signal; transmit the determined compensated data signal to the power source management module 103; and control the power source management module 103 to output a compensated data voltage to the one or more pixel unit according to the compensated data signal, such that the one or more pixel unit reaches the reference pixel voltage.

According to at least one embodiment of the present disclosure, the plurality of thermosensitive sensors 101, the processor 102 and the power source management module 103 cooperate with one another. Based on temperature information of one or more pixel unit as detected by a corresponding one of the plurality of thermosensitive sensors 101, the power source management module 103 is controlled to output compensated data voltage of the one or more pixel unit, such that the one or more pixel unit reaches a reference pixel voltage. Compared with a method for the compensation of voltage in related technologies that use a device to sense electronic or optical characteristics of the pixels, the detection of temperature information of the one or more corresponding pixel unit in at least one embodiment of the present disclosure costs less time, so the compensation of voltage for the one or more pixel unit has a high efficiency. Moreover, the thermosensitive sensors cost less than the device for sensing pixels, so that it is applicable to large-scaled production. At least one embodiment of the present disclosure achieve an effect of improving image display quality of the display with low cost and less time.

In some examples, each pixel unit in the display device may correspond to a thermosensitive sensor. In other examples, the display device may be divided into display areas, each display area corresponding to a thermosensitive sensor. The present disclosure is not limited in this regard.

In a voltage compensation device provided by the embodiment of the present disclosure, according to an example, the plurality of thermosensitive sensors 101 are electrically connected to the processor 102 via I2C (Inter-Integrated Circuit) or SPI (Serial Peripheral Interface).

In an example, the plurality of thermosensitive sensors 101 transmit the electrical signals on temperature to the processor 102 via the I2C or the SPI. The processor 102 and the power source management module 103 may also be connected via the I2C. In this example, the processor 102 transmits a compensated data signal corresponding to a target pixel unit (e.g., a pixel unit to be compensated) to the power source management module 103 via the I2C, such that the power source management module 103 outputs a compensated data voltage to the target pixel unit according to the compensated data signal.

In at least one embodiment of the present disclosure, the processor 102 may be a TCON (Timer Control Register) or an MCU (Microcontroller Unit). The power source management module 103 may be a PMIC (Power Management IC) or the like.

At least one embodiment of the present disclosure further provides a display device, the structure of which is as shown in FIG. 1. The display device comprises a display panel 104 and a voltage compensation device as mentioned above. Each pixel unit in the display panel 104 comprises an organic light-emitting diode (OLED). Each of the plurality of thermosensitive sensors 101 is disposed at a position corresponding the OLED of one or more pixel unit.

The voltage compensation for the pixel unit as performed by the display device according to at least one embodiment of the present disclosure has favorable effects identical with those of the voltage compensation device according to at least one embodiment of the present disclosure, which have been mentioned above and will not be repeated here.

Figure 2:
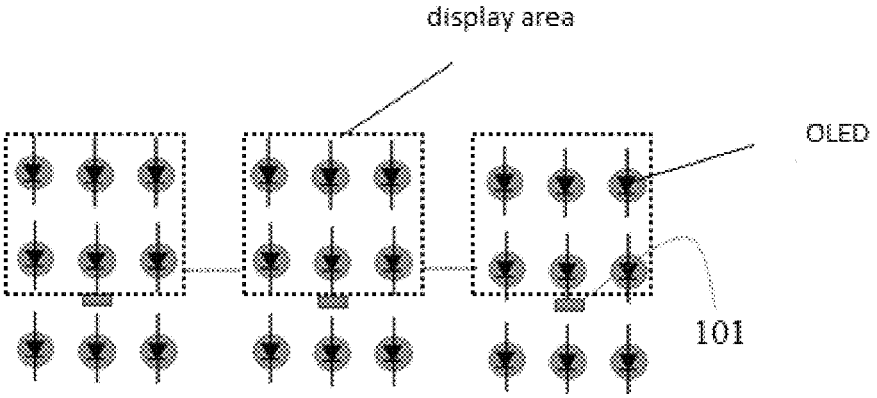
FIG. 2 is a diagram showing a specific position where thermosensitive sensors are specifically disposed according to at least one embodiment of the present disclosure.

In an example, one thermosensitive sensor is provided for an OLED of each pixel unit. In another example, the display device is divided into a plurality of display areas each with more than one pixel unit, and one thermosensitive sensor is provided for OLEDs of the more than one pixel unit within each display area. As shown in FIG. 2, the more than one pixel unit (e.g., the OLEDs of the more than pixel units) within each display area correspond to one thermosensitive sensor.

In the embodiment of the present disclosure, the thermosensitive sensors 101 may be provided at a variety of positions. For example, in an example, the thermosensitive sensors 101 are provided in a cathode layer of the OLED. For example, in another example, the display device according to at least one embodiment of the present disclosure further comprises a thin film encapsulation (TFE) layer, and the thermosensitive sensors 101 may be provided in the TFE layer. For example, in still another example, the display device according to at least one embodiment of the present disclosure may further comprise a heat sink, and the thermosensitive sensors 101 may be provided on the heat sink.

The positions where the thermosensitive sensors may be provided as mentioned above are exemplary, and in practical applications, under the condition of ensuring normal operation of the thermosensitive sensors (for example, normal detection of temperature information of the pixel unit), the user may set the positions of the thermosensitive sensors by him/herself according to the need. The present disclosure is not limited in this regard.

Figure 3:
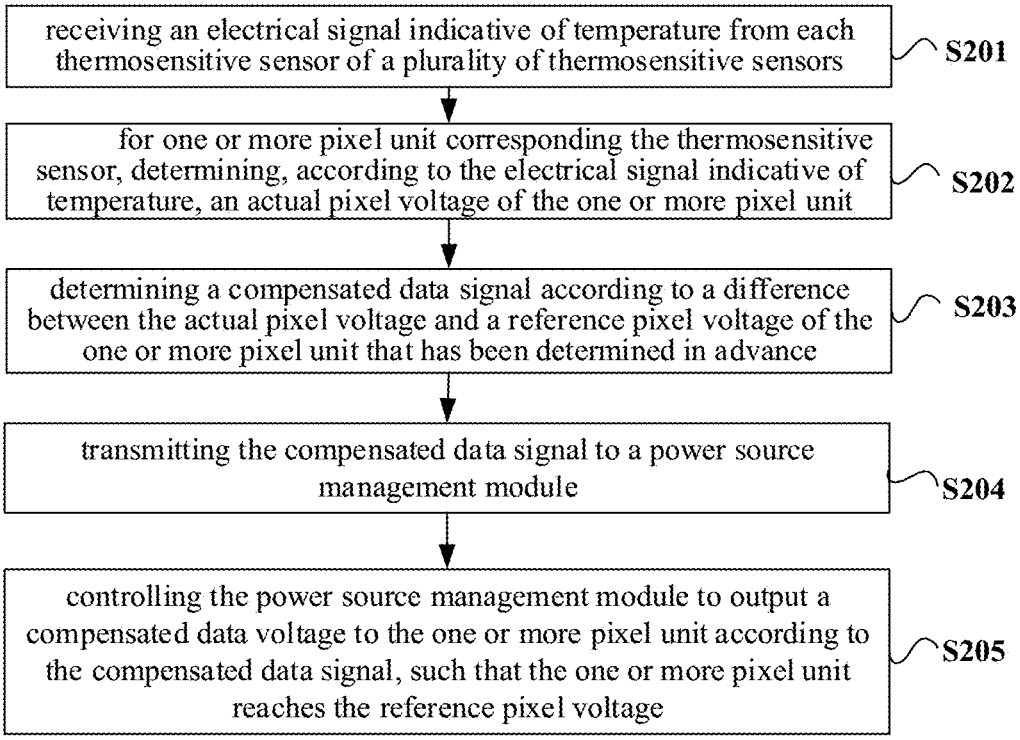
FIG. 3 is a flow chart showing a method for voltage compensation of a pixel unit according to at least one embodiment of the present disclosure.

At least one embodiment of the present disclosure further provides a method for voltage compensation, the flow of which is as shown in FIG. 3. The method comprises the following steps.

In S201, an electrical signal indicative of temperature is received from each thermosensitive sensor of a plurality of thermosensitive sensors.

In S202, an actual pixel voltage of one or more pixel unit corresponding to the thermosensitive sensor is determined according to the electrical signal indicative of temperature.

In S203, a difference between the actual pixel voltage and a reference pixel voltage of the one or more pixel unit that has been determined in advance is determined.

In S204, the compensated data signal as determined is transmitted to a power source management module.

In S205, the power source management module is controlled to output a compensated data voltage of the one or more pixel unit according to the compensated data signal, such that the one or more pixel unit reaches the reference pixel voltage.

Likewise, the voltage compensation for the pixel unit by application of the method for voltage compensation of at least one embodiment of the present disclosure has favorable effects identical with those of the voltage compensation device provided by at least one embodiment of the present disclosure, which have been mentioned above and will not be repeated here.

In an example, in S202, determining an actual pixel voltage of the pixel unit corresponding to the thermosensitive sensor comprises: determining an actual pixel voltage of the one or more pixel unit corresponding to the electrical signal indicative of temperature based on correspondences between temperatures and actual pixel voltages.

For example, the correspondences may include a correspondence between temperature information of the respective pixel unit in the display panel and the actual pixel voltage that is determined in advance by related technicians through a number of tests or experiments (e.g., correspondence between predetermined temperatures and actual pixel voltages). In an example, a table of correspondences may be set. When the electrical signal indicative of temperature fed back from the thermosensitive sensor is received, since the electrical signal indicative of temperature includes a temperature of the one or more pixel unit corresponding to the current thermosensitive sensor, an actual voltage corresponding to the current temperature of the pixel unit can be determined from the table of correspondence between the predetermined temperature and the actual pixel voltage.

In an example, prior to receipt of the electrical signal indicative of temperature fed back from the thermosensitive sensor (for example, prior to S201), the method may comprise: determining a reference pixel voltage corresponding to the pixel unit according to a brightness signal of the pixel unit (for example, received previously); and controlling the power source management module to output an initial source end voltage that is numerically equal to the reference pixel voltage to the pixel unit.

Figure 4:
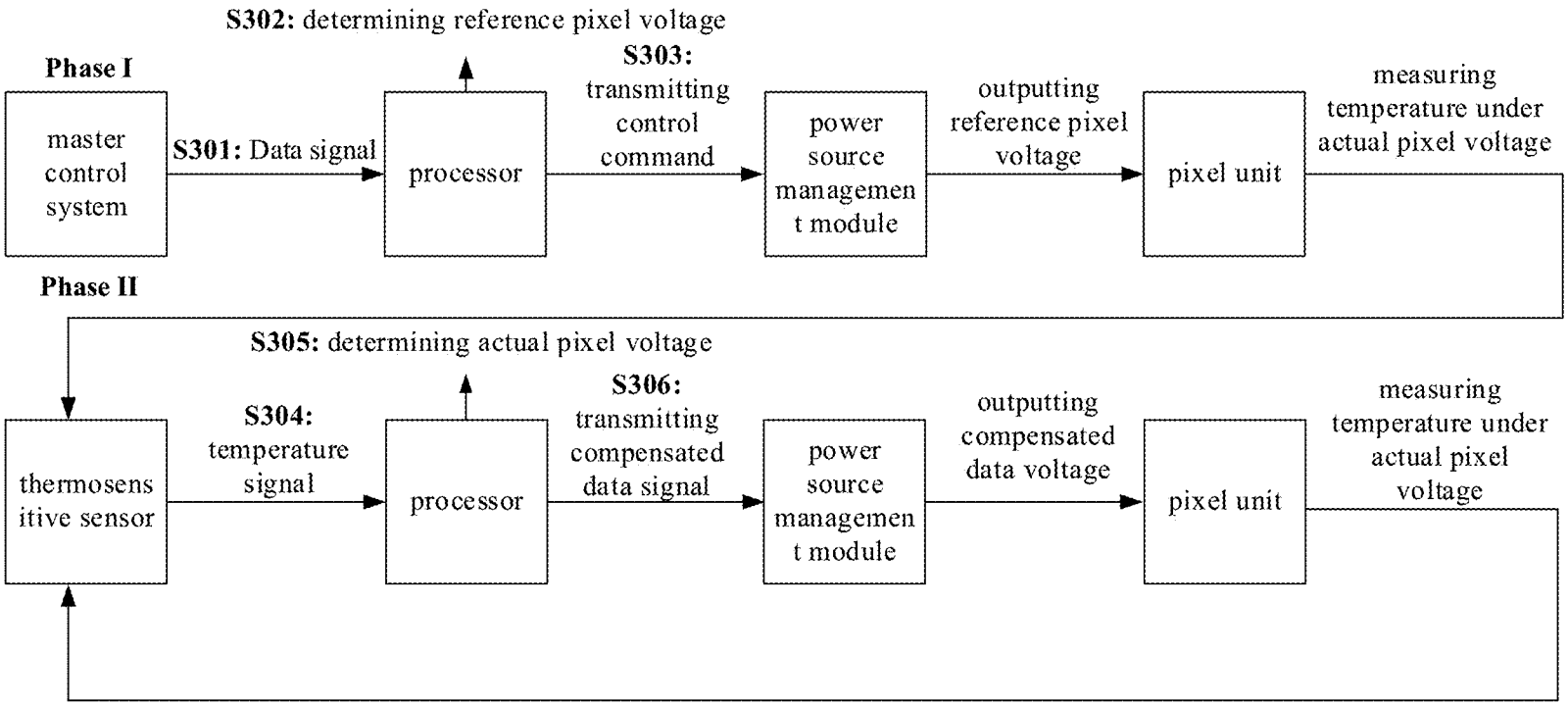
FIG. 4 is a diagram showing the principle of voltage compensation performed in at least one embodiment of the present disclosure.

The principle of voltage compensation according to at least one embodiment of the present disclosure will be described in details below, with reference to, for example, FIG. 4. The process of voltage compensation by the voltage compensation device according to at least one embodiment of the present disclosure may be divided into two stages, which are specifically described below.

Stage I:

In S301, a master control system in the display device sends a Data signal to the processor, wherein the Data signal including display brightness (brightness values) of the respective display areas in the display device.

S302, after receiving the Data signal, the processor determines a reference pixel voltage of a respective pixel unit based on a correspondence between a brightness value and a reference pixel voltage of the respective pixel unit that has been determined in advance.

S303, after the reference pixel voltage is determined, a control command is sent to the power source management module, causing the power source management module to output an initial source end voltage that is numerically equal to the reference pixel voltage to the respective pixel unit.

Step II:

In S304, a corresponding thermosensitive sensor of the plurality of thermosensitive sensors detects temperature information of the respective pixel unit and transmits to the processor an electrical signal indicative of temperature carrying this temperature information.

In S305, after receiving the electrical signal indicative of temperature, the processor determines an actual pixel voltage of the pixel unit corresponding to the thermosensitive sensor according to the temperature information included in the electrical signal indicative of temperature.

In S306, a compensated data signal is determined according to a difference between the actual pixel voltage and a reference pixel voltage of the pixel unit that has been determined in advance, the compensated data signal is transmitted to the power source management module, and the power source management module is controlled to output a compensated data voltage of the pixel unit according to the compensated data signal, such that the pixel unit reaches the reference pixel voltage.

In is possible that in S306, a voltage compensation for once may not enable the pixel unit to reach the reference voltage, and in this case, S304-S306 may be performed repeatedly until the thermosensitive sensor detects the actual pixel voltage corresponding to the temperature information of the pixel unit reaches (or approaches) the reference pixel voltage.

In order to illustrate the principle of voltage compensation in a clear manner, further interpretations are provided in the following examples.

As shown in Table 1, for example, in an initial state, the pixel unit has a predetermined reference pixel voltage of 10V, the processor controls the power source management module to output an initial source end voltage of 10V to the pixel unit. Temperature information of the pixel unit is detected by the thermosensitive sensor, and an electrical signal indicative of temperature including the temperature information is transmitted to the processor. Based on the temperature information, the processor determines an actual pixel voltage of the current pixel unit is 9V, and a difference between the current actual pixel voltage and the reference pixel voltage is 1V. At this time, the processor transmits a compensated data signal corresponding to the pixel unit to the power source management module. Based on the compensated data signal, the power source management module outputs a compensated data voltage of the pixel unit, which is 11V (the reference pixel voltage +the difference), enabling the pixel unit to have a voltage of 10V (i.e., the reference pixel voltage). For example, the power source management module directly outputs a voltage of 11V, which has a 1V loss during voltage transmission to the pixel unit, and finally the pixel unit has a voltage of 10V.

TABLE 1

| | |
|---|---|
| Reference pixel voltage | 10 V |
| Initial source end voltage | 10 V |
| Actual pixel voltage 1 | 9 V |
| Compensated source end voltage | 11 V |
| Actual pixel voltage 2 | 10 V |

In practical applications, a voltage actually outputted from the pixel unit is usually less than the reference pixel voltage since the display undergoes long-term pressurization and high temperature, such that threshold voltage in the respective areas of the display panel will have a drift. Moreover, since the drive circuit is connected to each of the pixel units via wires that have resistance, voltage drop would occur during transmission. Therefore, generally, voltage reaching the respective pixel unit would be less than that outputted from the power source management module.

In addition, due to difference in distance between respective pixel units and the drive circuit (i.e., length of the connecting wire), respective pixel units have different voltage drops.

The example in Table 1 as illustrated above merely illustrates an ideal condition, i.e., the source end voltage outputted from the power source management module to the pixel unit has a voltage drop of 1V each time. In practical applications, however, generally the voltages reaching the pixel unit do not always have the same voltage drop. In this case, adjustments have to be made by multiple times of compensation as mentioned above, until the actual pixel voltage of the pixel unit reaches (or approaches) the reference pixel voltage.

According to at least one embodiment of the present disclosure, the plurality of thermosensitive sensors, the processor and the power source management module cooperate with one another. Based on temperature information of the pixel unit detected by the corresponding one of the plurality of thermosensitive sensors, the power source management module is controlled to output compensated data voltage of the pixel unit, such that the pixel unit reaches a reference pixel voltage. Compared with a method for the compensation of voltage in related technologies that use a device to sense electronic or optical characteristics of the pixels, the detection of temperature information of the corresponding pixel unit in at least one embodiment of the present disclosure costs less time, so the compensation of voltage for the pixel unit has a high efficiency. Moreover, the thermosensitive sensors cost less than the device for sensing pixels, so that it is applicable to large-scaled production. At least one embodiment of the present disclosure achieves an effect of improving image display quality of the display with low cost and less time.

The above contents are merely a part of at least one embodiment of the present disclosure. It should be pointed out that ordinary technicians in the art may, without departing from the principle of the present disclosure, make several improvements and modifications, which shall be deemed to fall into the protection scope of the present disclosure

What is claimed is:

1. A voltage compensation device, comprising:

a plurality of thermosensitive sensors, each of which corresponds to one or more pixel units of a display device and is disposed at a position corresponding to the one or more pixel units;

a power source management module; and a processor electrically connected to the plurality of thermosensitive sensors and the power source management module, for each thermosensitive sensor of the plurality of thermosensitive sensors and the one or more pixel units that corresponds to the thermosensitive sensor, the processor being configured to:

determine, according to an electrical signal indicative of temperature received from the thermosensitive sensor, an actual pixel voltage of the one or more pixel units;

determine, according to a difference between the actual pixel voltage and a reference pixel voltage of the one or more pixel units that has been determined in advance, a compensated data signal;

transmit the compensated data signal to the power source management module; and control the power source management module to output a compensated data voltage to the one or more pixel units according to the compensated data signal, enabling the one or more pixel units to reach or approach the reference pixel voltage.

2. The voltage compensation device according to claim 1, wherein each pixel unit of the one or more pixel units comprises an organic light-emitting diode (OLED), and one thermosensitive sensor of the plurality of thermosensitive sensors is provided for the OLED of each pixel unit.

3. The voltage compensation device according to claim 2, wherein the one thermosensitive sensor is provided in a cathode layer of the OLED.

4. The voltage compensation device according to claim 1, wherein the display device comprises a plurality of display areas each with more than one pixel unit, each pixel unit comprises an organic light-emitting diode (OLED), and one thermosensitive sensor of the plurality of thermosensitive sensors is provided for OLEDs of the more than one pixel unit within each display area.

5. The voltage compensation device according to claim 4, wherein the one thermosensitive sensor is provided in a cathode layer of the OLEDs.

6. The voltage compensation device according to claim 1, wherein the display device further comprises a thin film encapsulation layer, and the plurality of thermosensitive sensors are provided in the thin film encapsulation layer.

7. The voltage compensation device according to claim 1, wherein the display device further comprises a heat sink, and the plurality of thermosensitive sensors are provided on the heat sink.

8. The voltage compensation device according to claim 1, wherein the plurality of thermosensitive sensors are electrically connected to the processor via at least one of an Inter-Integrated Circuit (I2C) or a Serial Peripheral Interface (SPI).

9. A display device, comprising:

a display panel comprising a plurality of pixel units; and a voltage compensation device, wherein the voltage compensation device comprises:

a plurality of thermosensitive sensors, each of which corresponds to one or more pixel units of the plurality of pixel units and is disposed at a position corresponding to the one or more pixel units;

a power source management module; and a processor, electrically connected to the plurality of thermosensitive sensors and the power source management module, for each thermosensitive sensor of the plurality of thermosensitive sensors and one or more pixel units that corresponds to the thermosensitive sensor, the processor being configured to:

determine, according to an electrical signal indicative of temperature received from the thermosensitive sensor, an actual pixel voltage of the one or more pixel units;

determine, according to a difference between the actual pixel voltage and a reference pixel voltage of the one or more pixel units that has been determined in advance, a compensated data signal;

transmit the compensated data signal to the power source management module; and control the power source management module to output a compensated data voltage to the one or more pixel units according to the compensated data signal, enabling the one or more pixel units to reach or approach the reference pixel voltage.

10. The pixel circuit according to claim 9, wherein each pixel unit of the one or more pixel units comprises an organic light-emitting diode (OLED), and one thermosensitive sensor of the plurality of thermosensitive sensors is provided for the OLED of each pixel unit.

11. The display device according to claim 10, wherein the one thermosensitive sensor is provided in a cathode layer of the OLED.

12. The display device according to claim 9, wherein the display device comprises a plurality of display areas each with more than one pixel unit, each pixel unit comprises an organic light-emitting diode (OLED), and one thermosensitive sensor of the plurality of thermosensitive sensors is provided for OLEDs of the more than one pixel unit within each display area.

13. The display device according to claim 12, wherein the one thermosensitive sensor is provided in a cathode layer of the OLEDs.

14. The display device according to claim 9, wherein the display device further comprises a thin film encapsulation layer, and the plurality of thermosensitive sensors are provided in the thin film encapsulation layer.

15. The display device according to claim 9, wherein the display device further comprises a heat sink, and the plurality of thermosensitive sensors are provided on the heat sink.

16. A method for voltage compensation, comprising:

receiving an electrical signal indicative of temperature from each thermosensitive sensor of a plurality of thermosensitive sensors;

for one or more pixel units corresponding to one of the plurality of thermosensitive sensors, determining, according to the electrical signal indicative of temperature, an actual pixel voltage of the one or more pixel units;

determining a compensated data signal according to a difference between the actual pixel voltage and a reference pixel voltage of the one or more pixel units that has been determined in advance;

transmitting the compensated data signal to a power source management module; and controlling the power source management module to output a compensated data voltage to the one or more pixel units according to the compensated data signal, such that the one or more pixel units reach the reference pixel voltage.

17. The method according to claim 16, wherein determining, according to the electrical signal indicative of temperature, the actual pixel voltage of the one or more pixel units comprises:

determining, according to correspondences between temperatures and actual pixel voltages that have been determined in advance, the actual pixel voltage of the one or more pixel units corresponding to the electrical signal indicative of temperature.

18. The method according to claim 16, further comprising, prior to receiving the electrical signal indicative of temperature from each thermosensitive sensor of the plurality of thermosensitive sensors:

determining, according to a brightness signal of the one or more pixel units, a reference pixel voltage corresponding to the one or more pixel units; and controlling the power source management module to output to the one or more pixel units an initial source end voltage that is numerically equal to the reference pixel voltage.

* * * * *